US008253521B2

(12) United States Patent
Brennan

(10) Patent No.: US 8,253,521 B2
(45) Date of Patent: Aug. 28, 2012

(54) HIGH CURRENT INDUCTOR ASSEMBLY

(75) Inventor: Daniel Brennan, Braintree, MA (US)

(73) Assignee: Murata Power Solutions, Mansfield, MA (US)

( * ) Notice: Subject to any disclaimer, the term of this patent is extended or adjusted under 35 U.S.C. 154(b) by 0 days.

(21) Appl. No.: 13/030,163

(22) Filed: Feb. 18, 2011

(65) Prior Publication Data

US 2011/0205008 A1 Aug. 25, 2011

Related U.S. Application Data

(60) Provisional application No. 61/306,143, filed on Feb. 19, 2010.

(51) Int. Cl.
*H01F 27/29* (2006.01)
*H01F 17/04* (2006.01)
*H01F 27/28* (2006.01)

(52) U.S. Cl. ..... 336/192; 336/83; 336/221; 336/222; 336/223; 336/225

(58) Field of Classification Search ..... 336/83, 336/220–223, 225, 192
See application file for complete search history.

(56) References Cited

U.S. PATENT DOCUMENTS

| | | | | |
|---|---|---|---|---|
| 4,538,132 | A * | 8/1985 | Hiyama et al. | 336/221 |
| 5,331,536 | A * | 7/1994 | Lane | 363/126 |
| 6,249,202 | B1 * | 6/2001 | Yamada | 336/65 |
| 6,344,786 | B1 * | 2/2002 | Chin | 336/198 |
| 6,522,233 | B1 | 2/2003 | Kyoso et al. | |
| 8,004,380 | B2 * | 8/2011 | Moiseev | 336/170 |
| 2002/0158738 | A1 * | 10/2002 | Hsu et al. | 336/83 |
| 2008/0074225 | A1 * | 3/2008 | Hansen et al. | 336/83 |
| 2009/0115559 | A1 * | 5/2009 | Feist et al. | 336/105 |

FOREIGN PATENT DOCUMENTS

| | | | |
|---|---|---|---|
| JP | 63-134470 | U | 9/1988 |
| JP | 2000-068129 | A | 3/2000 |
| JP | 2000-306751 | A * | 11/2000 |

* cited by examiner

*Primary Examiner* — Mohamad Musleh
*Assistant Examiner* — Mangtin Lian
(74) *Attorney, Agent, or Firm* — Keating & Bennett, LLP

(57) ABSTRACT

An inductor winding includes first, second, and third arms, a middle portion extending between and connected to at least two of the first, second, and third arms and arranged to support a winding core mounted thereon, and first, second, and third legs extending downwardly from the first, second and third arms, respectively, and arranged to be mounted on a circuit board. The first, second, and third legs are arranged to provide three-point contact with the circuit board, and the inductor winding is arranged to provide a space between a bottom surface of the winding core mounted on the middle portion and an upper surface of electronic components mounted on the circuit board.

20 Claims, 4 Drawing Sheets

HIGH CURRENT INDUCTOR ASSEMBLY

BACKGROUND OF THE INVENTION

1. Field of the Invention

The present invention relates to an inductor assembly, and in particular, to an inductor winding structure provided in a high current inductor assembly on which an inductor core is mounted.

2. Description of the Related Art

Inductor assemblies are commonly used for various high current applications, such as switching power supply devices. High current inductor assemblies are relatively large, and thus, occupy a relatively large portion and in many cases the majority of a circuit board on which they are mounted. This causes a problem in that, in order to provide sufficient space for both the inductor assemblies and other required electronic components to be mounted on a circuit board, the size of the circuit board must be significantly increased.

A known inductor assembly is configured such that the bottom surface of the inductor core is in contact with or arranged very close to a surface of the circuit board. With this configuration, the amount of space occupied by the inductor assembly is defined by the outer dimensions of the overall inductor assembly. Thus, this configuration causes a problem in that each of the inductor assemblies occupies a large amount of space on the circuit board, which significantly reduces the amount of space on the circuit board on which other electronic components can be mounted.

Another known inductor assembly includes an inductor winding that is configured to be in contact with and mounted to a circuit board at four different points. However, such an inductor winding has a problem in that one of the four points that is supposed to be in contact with and mounted to the circuit board may not be coplanar with the other three mounting points, which could result in the one of the four points not being securely connected, either electrically or mechanically, to the circuit board.

BACKGROUND OF THE INVENTION

In order to overcome the problems described above, preferred embodiments of the present invention provide an inductor winding and an inductor assembly which enables better cooling of electronic components mounted on a circuit board, improves electrical and mechanical connection of the inductor winding to the circuit board, and allows other electronic components to be mounted on the circuit board beneath the inductor assembly so as to maximize the space on the circuit board on which the other electronic components can be mounted.

An inductor winding according to a preferred embodiment of the present invention includes first, second, and third arms, a middle portion extending between and connected to at least two of the first, second, and third arms and arranged to support a winding core mounted thereon, and first, second, and third legs extending downwardly from the first, second and third arms, respectively, and arranged to be mounted on a circuit board. The first, second, and third legs are arranged to provide three-point contact with the circuit board, and the inductor winding is arranged to provide a space between a bottom surface of the winding core mounted on the middle portion and an upper surface of electronic components mounted on the circuit board.

Each of the first, second, and third legs preferably includes an intermediate portion connected to and extending from the first, second, and third arms, respectively, and a foot connected to and extending at an angle from the intermediate portion. The intermediate portion of two of the first, second, and third legs preferably extends vertically or substantially vertically from the respective first, second, and third arms, and the intermediate portion of a remaining one of the first, second, and third legs extends horizontally or substantially horizontally from a remaining one of the first, second, and third arms, and the foot of the two of the first, second, and third legs preferably extends horizontally or substantially horizontally from the intermediate portion of the two of the first, second, and third legs, and the foot of the remaining one of the first, second, and third legs preferably extends vertically or substantially vertically from intermediate portion of the remaining one of the first, second, and third legs.

At least one of the first, second, and third feet preferably includes a slit provided therein. More preferably, each of the first, second, and third feet includes a slit provided therein.

The middle portion preferably has a substantially plate shape including opposed main surfaces that extend in a horizontal or substantially horizontal direction. Each of the first, second, and third legs preferably has a substantially plate shape including opposed main surfaces that extend in a vertical or substantially vertical direction.

A first end portion of the middle portion is preferably connected to and extends from an end portion of the first arm and a second end portion opposite to the first end portion of the middle portion is preferably connected to and extends from a central portion of the second arm, and an end portion of the third arm is preferably connected to and extends from an end portion of the second arm. The first leg preferably extends downwardly from an end portion of the first arm opposite to the end portion of the first arm connected to and extending from the middle portion, the second leg preferably extends downwardly from an end portion of the second arm opposite to the end portion of the second arm connected to and extending from the third arm, and the third leg preferably extends downwardly from an end portion of the third arm opposite to the end portion of third arm connected to and extending from the end portion of the second arm.

An inductor assembly according to another preferred embodiment of the present invention includes an inductor winding according to a preferred embodiment of the present invention, and the inductor winding and the inductor core are arranged to provide a space between a bottom surface of the winding core and an upper surface of electronic components mounted on the circuit board.

The inductor core preferably includes upper and lower portions arranged to sandwich the middle portion of the inductor winding therebetween. At least one of the upper and lower portions of the inductor core preferably includes a groove arranged to accommodate the middle portion of the inductor winding therein.

Other features, elements, characteristics and advantages of the present invention will become more apparent from the following detailed description of preferred embodiments of the present invention with reference to the attached drawings.

DETAILED DESCRIPTION OF THE PREFERRED EMBODIMENTS

Preferred embodiments of the present invention will be described below with reference to the accompanying drawing.

As shown in FIGS. 1-4, an inductor winding according to a preferred embodiment of the present invention 1 preferably includes a middle portion 3 and first, second, and third legs 2*a*, 2*b*, and 2*c* that are preferably arranged in a tripod design, for example, and that are connected to the middle portion 3 by first, second, and third arms 4*a*, 4*b*, and 4*c*. The middle portion 3 extends between and is connected to the first and second arms 4*a* and 4*b*. Preferably, one end of the middle portion 3 is connected to an end portion of the first arm 4*a* and the other end of the middle portion 3 is connected to a central portion of the second arm 4*b*. However, the middle portion 3 may be arranged to extend between and be connected to any suitable portions of any of the first, second, and third arms 4*a*, 4*b*, and 4*c*.

Figure 3:
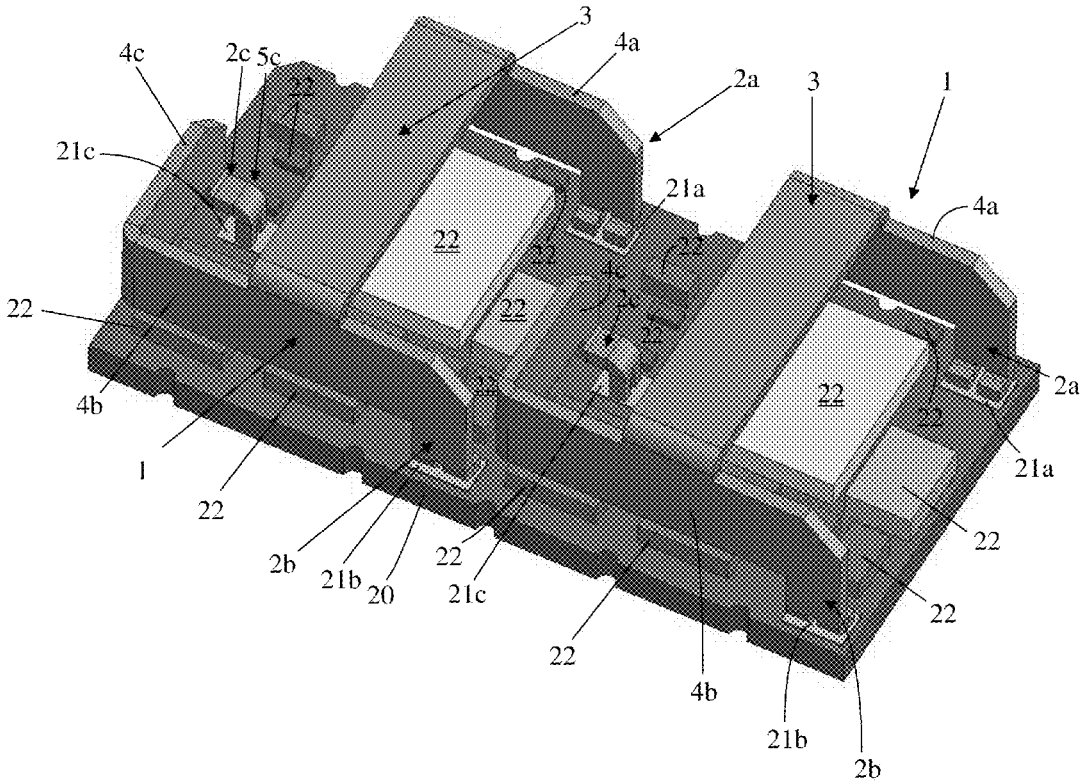
FIG. 3 is a perspective view of two inductor windings without cores mounted to a circuit board.
Figure 4:
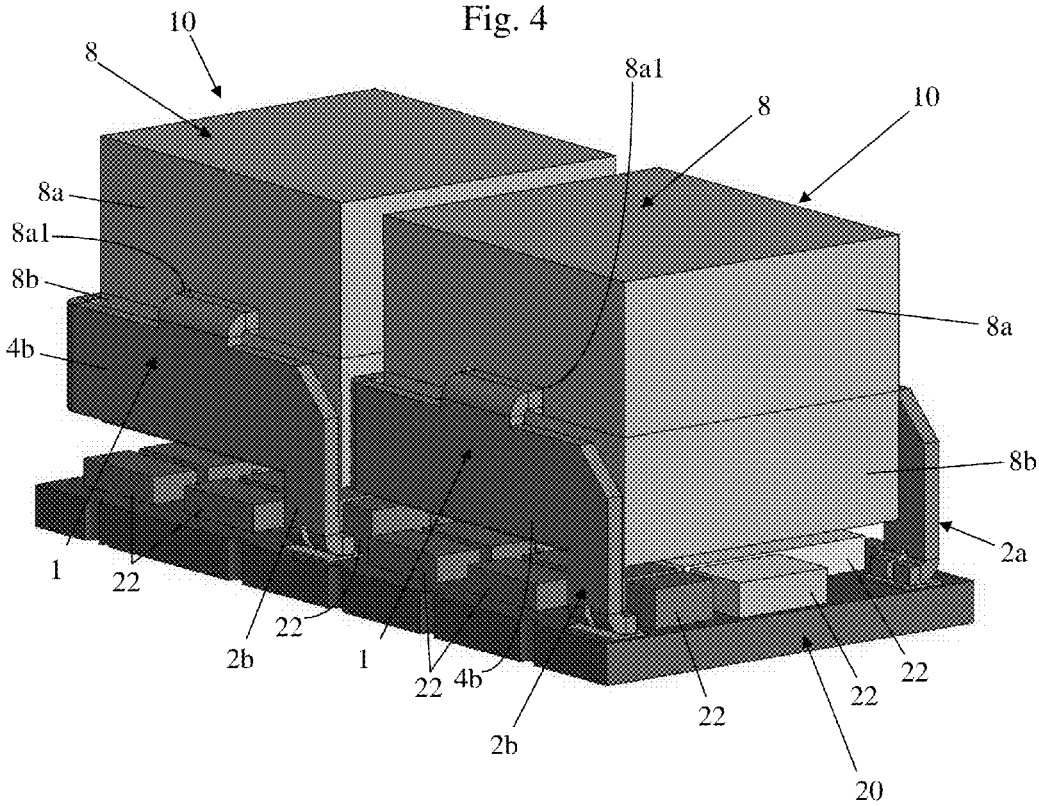
FIG. 4 is a perspective view of two high current inductor assemblies with inductor windings and cores mounted to a circuit board.

The middle portion 3 is preferably arranged to extend in a direction perpendicular or substantially perpendicular to a direction in which the first and second arms 4*a* and 4*b* extend and parallel or substantially parallel to a direction is which the third arm 4*c* extends. In addition, the middle portion 3 is preferably arranged to extend in a direction parallel or substantially parallel to a surface of the circuit board 20 on which the inductor winding 1 is mounted, as shown in FIGS. 3 and 4. The third arm 4*c* is preferably connected to an end of the second arm 4*b* and the direction in which the third arm 4*c* extends is perpendicular or substantially perpendicular to the direction in which the second arm 4*b* extends. The first and second arms 4*a* and 4*b* are preferably arranged to be parallel or substantially parallel to one another. However, the middle portion 3 may be arranged to extend in any suitable direction with respect to the first, second, and third arms 4*a*, 4*b*, and 4*c*. Further, the first, second, and third arms 4*a*, 4*b*, and 4*c* may be arranged to extend in any suitable direction with respect to each other.

Preferably, the middle portion 3 and each of the first, second, and third arms 4*a*, 4*b*, and 4*c* are substantially plate shaped. The plate shaped middle portion is preferably arranged to have opposed main surfaces that extend in a horizontal or substantially horizontal direction, and the plate shaped first, second, and third arms 4*a*, 4*b*, and 4*c* are preferably arranged to have opposed main surfaces that extend in vertical or substantially vertical directions. However, the middle portion 3 and each of the first, second, and third arms 4*a*, 4*b*, and 4*c* may have any suitable shapes.

The first, second, and third legs 2*a*, 2*b*, and 2*c* extend downward from the first, second, and third arms 4*a*, 4*b*, and 4*c*, respectively. The first leg 2*a* preferably extends from an end portion of the first arm 4*a* opposite to the end portion of the first arm 4*a* at which the middle portion 3 is connected. The second leg 2*b* is preferably connected to an end portion of the second arm 4*b* opposite to the end portion at which the third arm 4*c* is connected. The third leg 2*c* is preferably connected to an end portion of the third arm 4*c* opposite to the end portion of the third arm 4*c* that is connected to the second arm 4*b*.

The first and second legs 2*a* and 2*b* preferably include vertically or substantially vertically extending intermediate portions 6*a* and 6*b* connected to and extending from the respective first and second arms 4*a* and 4*b* and feet 5*a* and 5*b* connected to the respective intermediate portions 6*a* and 6*b* and extending in a horizontal or substantially horizontal direction. The third leg 2*c* preferably includes an intermediate portion 6*c* connected to and extending from the third arm 4*c* and in a horizontal or substantially horizontal direction, and a foot 5*c* connected to and extending from the intermediate portion 6*c* and in a vertical or substantially vertical direction. However, each of the legs 2*a*, 2*b*, and 2*c* may have any suitable shape and configuration as long as the desired tripod configuration is provided.

Each of the feet 5*a*, 5*b*, and 5*c* of the first, second, and third legs 2*a*, 2*b*, and 2*c* preferably includes a respective slit 5*a*1, 5*b*1, and 5*c*1 in a central portion thereof. However, the feet 5*a*, 5*b*, and 5*c* of the first, second, and third legs 2*a*, 2*b*, and 2*c* may have any suitable configuration.

Figure 1:
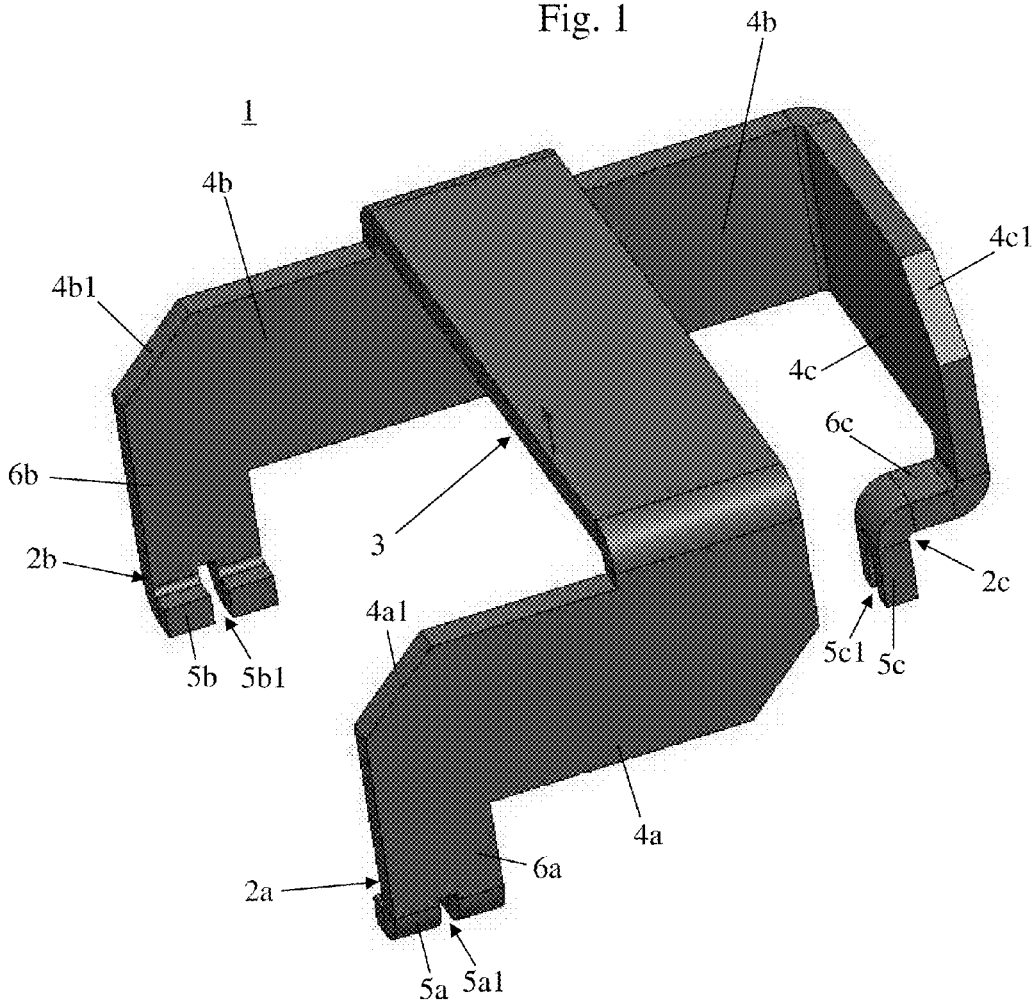
FIG. 1 is a top perspective view of an inductor winding that can be mounted to circuit board.
Figure 2:
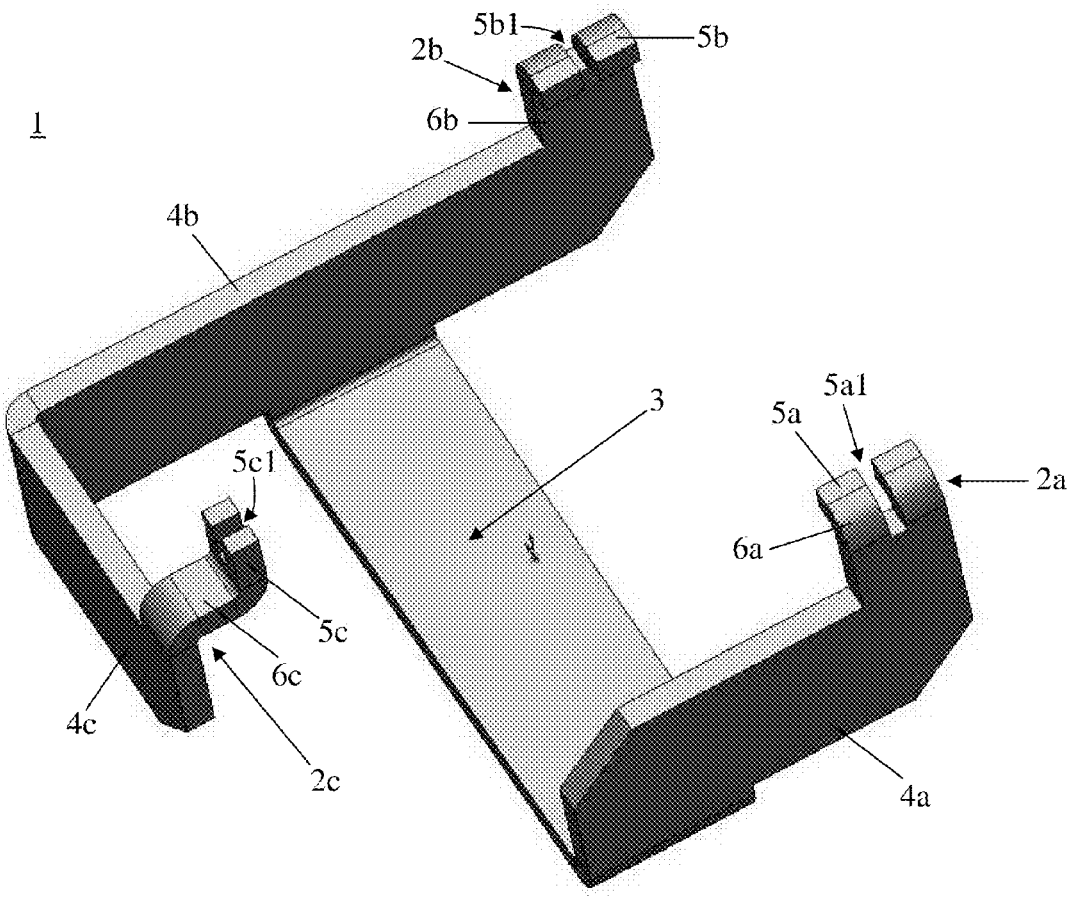
FIG. 2 is a bottom perspective view of an inductor winding that can be mounted to circuit board.

As shown in FIGS. 1 and 2, the end portion of each of the first, second, and third arms 4*a*, 4*b*, and 4*c* from which the first, second, and third legs 2*a*, 2*b*, and 2*c* respectively extend preferably includes an angled or chamfered surface 4*a*1, 4*b*1, and 4*c*1. However, the first, second, and third arms 4*a*, 4*b*, and 4*c* do not necessarily need to include the angled or chamfered surfaces 4*a*1, 4*b*1, and 4*c*1. Further, the shape of the surfaces 4*a*1, 4*b*1, and 4*c*1 may have any other suitable shape, such as a curved radius, for example. Eliminating the sharp corners of the first, second, and third arms 4*a*, 4*b*, and 4*c* by providing the surfaces 4*a*1, 4*b*1, and 4*c*1 improves electromagnetic interference (EMI) performance of the inductor assembly 1 and is preferable for safety and handling.

Preferably, the inductor winding 1 is formed from one or more pieces of metal as described below. The inductor winding 1 is preferably made of copper, for example. However, the inductor winding 1 may be formed by any suitable method using any suitable metal. For example, the inductor winding 1 may be formed by stamping and bending a plate-shaped piece of metal, so as to form a single, unitary member, and the inductor winding 1 may made be of aluminum, steel, or any copper alloy, such as brass.

As shown in FIG. 3, the inductor winding 1 is configured so as to be connected to a circuit board 20. Each of the legs 2*a*, 2*b*, and 2*c* of the inductor winding 1 are preferably configured and arranged to be aligned with and connected to a respective mounting pad 21*a*, 21*b*, and 21*c* on the circuit board 20 via solder or other suitable conductive adhesive (not shown), for example. More specifically, the bottom surfaces of each of the feet 5*a*, 5*b*, and 5*c* are preferably arranged to be in contact with a respective one of the mounting pads 21*a*, 21*b*, and 21*c* and then soldered thereto. The feet 5*a* and 5*b* of the first and second legs 2*a* and 2*b* are preferably configured to have an area that is greater than an area of the foot 5*c* of the third leg 2*c* because the first and second legs 2*a* and 2*b* are preferably arranged to define mounting legs and the third leg 2*c* is preferably arranged to define a stabilizing leg. That is, preferably, the first and second legs 2*a* and 2*b* are arranged to primarily provide the electrical and mechanical connection between the circuit 20 and the inductor winding 1, while the third leg 2*c* is arranged to maintain and stabilize to arrangement of the inductor winding 1 with respect to the circuit board 20. However, the inductor winding 1 may be configured and attached to the circuit board in any suitable manner.

As shown in FIG. 3, since the inductor winding 1 is attached to the circuit board 20 via the relatively small mounting pads 21*a*, 21*b*, and 21*c* at only three locations, the space required to mount the inductor winding 1 is minimized so as to maximize the amount of space on the circuit board for mounting various passive and active electronic components 22 thereon. The specific types of passive and active electronic components that are mounted on the circuit board 20 are dependent upon the specific application and are not particularly limited.

As shown in FIGS. 3 and 4, middle portion 3 and bottom edges of each of the first, second, and third arms 4*a*, 4*b*, and 4*c* of the inductor winding 1 are arranged to be spaced apart from the upper surface of the circuit board 20 so as to provide a space or clearance therebetween that is sufficiently large such that the desired electronic components 22 can be mounted on the circuit board 20 with a space or clearance between the upper surface of the electronic components 22 and the lower surface of the inductor core 8, as described below.

As shown in FIG. 4, reference number 10 denotes the inductor assembly which includes the inductor winding 1 and the inductor core 8. The inductor core 8 preferably includes an upper portion 8*a* and a lower portion 8*b* which are arranged to sandwich the middle portion 3 of the inductor winding 1. The upper portion 8*a* of the inductor core 8 according to a preferred embodiment of the present invention preferably includes a slot 8*a*1 provided therein that is configured to accommodate the middle portion 3 of the inductor winding 1 therein. However, a slot may be provided in the lower portion 8*b* of the inductor core 8 or slots may be provided in both of the upper portion 8*a* and the lower portion 8*b* of the inductor core 8, for example. Further, the inductor core 8 may be a floating inductor core that is not attached to the inductor winding 1 or the inductor core 8 may be attached to the inductor winding 1 with an adhesive, for example.

As shown in FIG. 4, when the inductor core 8 is mounted on the inductor winding 1, the lower surface of the inductor core 8 is arranged to be disposed above and spaced apart from the upper surfaces of all of the electronic components 22 mounted on the circuit board 20. With this configuration, sufficient space is provided between the bottom surface of the inductor core 8 and the upper surface of the circuit board 20 such that the electronic components 22 can be mounted on the circuit board 20 directly below the inductor core 8 in order to maximize the electronic component mounting space of the circuit board 20.

In addition, since the bottom surface of the inductor core 8 and the lower edges of the first, second, and third arms 4*a*, 4*b*, and 4*c* of the inductor winding 1 are arranged to be spaced apart from the upper surfaces of the electronic components 22, air is allowed to freely flow between the electronic components 22 and the inductor assembly 10 so as to significantly improve the cooling of the electronic components. Furthermore, since the heat generated by the electronic components 22 is significantly greater than the heat generated by the inductor assembly 10 during operation, the heat generated by the electronic components 22 is conducted away from the electronic components 22 and toward the inductor assembly 10, which further improves the cooling of the electronic components. In other words, the inductor assembly 10 functions as a heat sink.

As shown in FIGS. 3 and 4, one or more of the inductor assemblies 10 can be mounted on a circuit board as required without occupying a large amount of the surface of the circuit board 20.

Although not particularly limiting, the space between the upper surface of the circuit board 20 and the bottom surface of the inductor core 8 is preferably in the range of about 0.040 to 0.120 inches, for example. However, this distance is determined at the time of design, and may be set as necessary depending upon the height of the electronic components to be mounted on the circuit board, the cooling requirements of the particular application, the size requirements of the particular application, i.e. the need for a lower overall profile, and other relevant factors.

As shown in FIGS. 1-3, the inductor winding 1 preferably includes three legs 2*a*, 2*b*, and 2*c* that are arranged in a tripod design. That is, the first, second, and third legs 2*a*, 2*b*, and 2*c* of the inductor winding 1 are arranged to support the inductor winding 1 at three points. With this configuration, the coplanarity of the feet 5*a*, 5*b*, and 5*c* of the first, second, and third legs 2*a*, 2*b*, and 2*c* is ensured such that each of the three feet 5*a*, 5*b*, and 5*c* is always firmly in contact with the circuit board 20. This configuration effectively ensures outstanding electrical and mechanical connection between the inductor winding 1 and the circuit board 20.

As shown in FIGS. 1-3, each of the feet 5*a*, 5*b*, and 5*c* preferably includes a slit 5*a*1, 5*b*1, and 5*c*1. The slits 5*a*1, 5*b*1, and 5*c*1 effectively increases the surface area of the feet 5*a*, 5*b*, and 5*c* that is in contact with the solder during reflow, which further improves the electrical and mechanical connection between the inductor assembly 10 and the circuit board 20.

With the configuration of the inductor winding 1 described above, a variety of different inductors cores, both standard and custom, can be used with the same inductor winding, which significantly reduces the cost of designing and manufacturing the inductor assembly 10.

It should be understood that the foregoing description is only illustrative of the present invention. Various alternatives and modifications can be devised by those skilled in the art without departing from the present invention. Accordingly, the present invention is intended to embrace all such alternatives, modifications, and variances that fall within the scope of the appended claims.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An inductor winding comprising:

first, second, and third arms;

a middle portion extending between and connected to at least two of the first, second, and third arms and arranged to support a winding core mounted thereon; and first, second, and third legs extending downwardly from the first, second and third arms, respectively, and arranged to be mounted on a circuit board; wherein the first, second, and third legs are arranged to provide three-point contact with the circuit board;

the inductor winding is arranged to provide a space between a bottom surface of the winding core mounted on the middle portion and an upper surface of electronic components mounted on the circuit board; and each of the first, second, and third legs are arranged to be located on different sides of the winding core when the middle portion supports the winding core.

2. The inductor winding according to claim 1, wherein each of the first, second, and third legs includes an intermediate portion connected to and extending from the first, second, and third arms, respectively, and a foot connected to and extending at an angle from the intermediate portion.

3. The inductor winding according to claim 2, wherein the intermediate portion of two of the first, second, and third legs extends vertically or substantially vertically from the respective first, second, and third arms, and the intermediate portion of a remaining one of the first, second, and third legs extends horizontally or substantially horizontally from a remaining one of the first, second, and third arms; and the foot of the two of the first, second, and third legs extends horizontally or substantially horizontally from the intermediate portion of the two of the first, second, and third legs, and the foot of the remaining one of the first, second, and third legs extends vertically or substantially vertically from intermediate portion of the remaining one of the first, second, and third legs.

4. The inductor winding according to claim 2, wherein at least one of the first, second, and third feet includes a slit provided therein.

5. The inductor winding according to claim 2, wherein each of the first, second, and third feet includes a slit provided therein.

6. The inductor winding according to claim 1, wherein the middle portion has a substantially plate shape including opposed main surfaces that extend in a horizontal or substantially horizontal direction.

7. The inductor winding according to claim 1, wherein each of the first, second, and third legs has a substantially plate shape including opposed main surfaces that extend in a vertical or substantially vertical direction.

8. The inductor winding according to claim 1, wherein a first end portion of the middle portion is connected to and extends from an end portion of the first arm and a second end portion opposite to the first end portion of the middle portion is connected to and extends from a central portion of the second arm; and an end portion of the third arm is connected to and extends from an end portion of the second arm.

9. The inductor winding according to claim 8, wherein the first leg extends downwardly from an end portion of the first arm opposite to the end portion of the first arm connected to and extending from the middle portion;

the second leg extends downwardly from an end portion of the second arm opposite to the end portion of the second arm connected to and extending from the third arm; and the third leg extends downwardly from an end portion of the third arm opposite to the end portion of third arm connected to and extending from the end portion of the second arm.

10. An inductor assembly comprising:

an inductor winding comprising:

first, second, and third arms;

a middle portion extending between and connected to at least two of the first, second, and third arms; and first, second, and third legs extending downwardly from the first, second and third arms, respectively, and arranged to be mounted on a circuit board; and an inductor core mounted on and supported by the middle portion of the inductor winding; wherein the first, second, and third legs of the inductor winding are arranged to provide three-point contact with the circuit board;

the inductor winding and the inductor core are arranged to provide a space between a bottom surface of the winding core and an upper surface of electronic components mounted on the circuit board; and each of the first, second, and third legs are located on different sides of the inductor core.

11. The inductor assembly according to claim 10, wherein each of the first, second, and third legs includes an intermediate portion connected to and extending from the first, second, and third arms, respectively, and a foot connected to and extending at an angle from the intermediate portion.

12. The inductor assembly according to claim 11, wherein the intermediate portion of two of the first, second, and third legs extends vertically or substantially vertically from the respective first, second, and third arms, and the intermediate portion of a remaining one of the first, second, and third legs extends horizontally or substantially horizontally from a remaining one of the first, second, and third arms; and the foot of the two of the first, second, and third legs extends horizontally or substantially horizontally from the intermediate portion of the two of the first, second, and third legs, and the foot of the remaining one of the first, second, and third legs extends vertically or substantially vertically from intermediate portion of the remaining one of the first, second, and third legs.

13. The inductor assembly according to claim 11, wherein at least one of the first, second, and third feet includes a slit provided therein.

14. The inductor assembly according to claim 11, wherein each of the first, second, and third feet includes a slit provided therein.

15. The inductor assembly according to claim 10, wherein the middle portion has a substantially plate shape including opposed main surfaces that extend in a horizontal or substantially horizontal direction.

16. The inductor assembly according to claim 10 wherein each of the first, second, and third legs has a substantially plate shape including opposed main surfaces that extend in a vertical or substantially vertical direction.

17. The inductor assembly according to claim 10, wherein a first end portion of the middle portion is connected to and extends from an end portion of the first arm and a second end portion opposite to the first end portion of the middle portion is connected to and extends from a central portion of the second arm; and an end portion of the third arm is connected to and extends from an end portion of the second arm.

18. The inductor assembly according to claim 17, wherein the first leg extends downwardly from an end portion of the first arm opposite to the end portion of the first arm connected to and extending from the middle portion;

the second leg extends downwardly from an end portion of the second arm opposite to the end portion of the second arm connected to and extending from the third arm; and the third leg extends downwardly from an end portion of the third arm opposite to the end portion of third arm connected to and extending from the end portion of the second arm.

19. The inductor assembly according to claim 10, wherein the inductor core includes upper and lower portions arranged to sandwich the middle portion of the inductor winding therebetween.

20. The inductor assembly according to claim 19, wherein at least one of the upper and lower portions of the inductor core includes a groove arranged to accommodate the middle portion of the inductor winding therein.

* * * * *